US005640854A

United States Patent [19]

Fogt et al.

[11] Patent Number: 5,640,854

[45] Date of Patent: Jun. 24, 1997

[54] SCROLL MACHINE HAVING LIQUID INJECTION CONTROLLED BY INTERNAL VALVE

[75] Inventors: James F. Fogt, Sidney; Jean-Luc Caillat, Dayton, both of Ohio

[73] Assignee: Copeland Corporation, Sidney, Ohio

[21] Appl. No.: 488,396

[22] Filed: Jun. 7, 1995

[51] Int. Cl.[6] ..... F25B 41/00; F01C 1/02

[52] U.S. Cl. ..... 62/197; 62/505; 418/55.6

[58] Field of Search ..... 62/505, 190, 498, 62/197; 418/55.6, 97; 236/92 B

[56] References Cited

U.S. PATENT DOCUMENTS

| | | | |
|---|---|---|---|
| 2,309,405 | 1/1943 | Matteson | 236/92 B |
| 2,577,107 | 12/1951 | Cooper | 62/505 X |
| 4,936,112 | 6/1990 | Miller | 62/505 |
| 4,974,427 | 12/1990 | Diab | 417/292 X |
| 5,076,067 | 12/1991 | Prenger et al. | 62/197 |
| 5,103,652 | 4/1992 | Mizuno et al. | 62/505 |
| 5,174,740 | 12/1992 | Jang | 418/55.6 |
| 5,329,788 | 7/1994 | Caillat et al. | 62/505 |
| 5,469,716 | 11/1995 | Bass et al. | 62/505 |

FOREIGN PATENT DOCUMENTS

| | | | |
|---|---|---|---|
| 57-76286A | 5/1982 | Japan . | |
| 0147982 | 6/1988 | Japan | 62/505 |
| 0245490 | 10/1990 | Japan | 418/55.6 |
| 2245490A | 10/1990 | Japan . | |
| 3144257 | 6/1991 | Japan | 62/498 |
| 3156186A | 7/1991 | Japan . | |
| 4124567 | 4/1992 | Japan | 62/498 |

*Primary Examiner*—William E. Wayner

*Attorney, Agent, or Firm*—Harness, Dickey & Pierce, P.L.C.

[57] ABSTRACT

A scroll compressor includes a liquid injection system. The liquid injection system receives liquid refrigerant from the refrigeration system at a point between the condenser and the evaporator. This liquid refrigerant is then injected into at least one enclosed space defined by the scrolls of the scroll compressor. The liquid injection system includes a valve which selectively controls the flow of liquid refrigerant to the enclosed space. The valve is responsive to the discharge pressure of the compressor.

34 Claims, 6 Drawing Sheets

SCROLL MACHINE HAVING LIQUID INJECTION CONTROLLED BY INTERNAL VALVE

FIELD OF THE INVENTION

The present invention relates to scroll-type machines. More particularly, the present invention relates to hermetic scroll compressors incorporating a liquid injection system where the liquid injection system is controlled by an internal valve.

BACKGROUND AND SUMMARY OF THE INVENTION

Refrigeration and air conditioning systems generally include a compressor, a condenser, an expansion valve or equivalent, and an evaporator. These components are coupled in sequence in a continuous flow path. A working fluid flows through the system and alternates between a liquid phase and a vapor or gaseous phase.

A variety of compressor types have been used in refrigeration systems, including but not limited to reciprocating compressors, screw compressors and rotary compressors. Rotary compressors can include the vane type compressors as well as the scroll machines. Scroll compressors are constructed using two scroll members with each scroll member having an end plate and a spiral wrap. The spiral wraps are arranged in an opposing manner with the two spiral wraps being interfitted. The scroll members are mounted so that they may engage in relative orbiting motion with respect to each other. During this orbiting movement, the spiral wraps define a successive series of enclosed spaces, each of which progressively decreases in size as it moves inwardly from a radially outer position at a relatively low suction pressure to a central position at a relatively high pressure. The compressed gas exits from the enclosed space at the central position through a discharge passage formed through the end plate of one of the scroll members.

Under any one of a number of adverse conditions, the discharge gas of the scroll compressor can become excessively hot, which in turn can adversely effect the efficiency as well as the durability of the compressor. One known prior art method of cooling the compressed gas is to inject liquid refrigerant from the condenser through an injection passage directly into the compressor. The liquid refrigerant may be injected into the suction gas area of the compressor or it may be injected into an intermediate enclosed space defined by the scroll members. These various methods are shown in U.S. Pat. No. 5,076,067, U.S. Pat. No. 4,974,427, U.S. Pat. No. 5,329,788 and U.S. patent application Ser. No. 08/237,449, filed May 3, 1994, entitled "Scroll Compressor With Liquid Injection", all of which are assigned to the same assignee as the present application, the disclosure of each of which is hereby incorporated herein by reference. It is desirable for optimum operating efficiency and effective cooling of the discharge gas that the liquid injection port be located as centrally or as close to the discharge passage, as is possible. Unfortunately, however, the centralized location of the injection port is limited by the liquid supply pressure at the outlet of the condenser, which is near the discharge pressure but still intermediate the suction pressure and the discharge pressure of the compressor. If the pressure of the gas in an enclosed space near the discharge port is greater than the condenser outlet liquid supply pressure throughout an entire cycle of orbiting motion, the liquid refrigerant cannot flow from the liquid injection passage into the enclosed space in the compressor.

It is therefore desirable either to lower the pressure of the central or innermost enclosed space to a pressure which is below the liquid supply pressure during at least a portion of the cycle of orbiting movement or to inject the liquid remotely enough from the discharge area so that the above stated constraints under space pressures are met. This lowering of the pressure will enable positive liquid injection through an injection port which can be located closer to the discharge port which is where the compressed refrigerant is the hottest and thus where cooling is most effective. One method of lowering the pressure in the central innermost enclosed chamber is the use of a dynamic one-way valve in the discharge passage which opens and closes once every cycle. Such one-way valves, however, can be noisy, have potential reliability implications, and they reduce compressor efficiency due to gas flow loss. In addition, these one-way valves require additional costs for the extra components, as well as additional costs for their assembly.

Additionally, some prior art designs of liquid injection systems utilize a solenoid valve for selectively blocking the flow of liquid refrigerant to the compressor when the refrigeration cycle is turned off. The purpose of these solenoid valves is to allow liquid injection while the compressor is running and to prevent the flow of refrigerant from the condenser to the enclosed spaces during times when the compressor is shut down, thus avoiding compressor flooding which can be the cause of severe damage due to liquid refrigerant slugging upon compressor startup. However, solenoids valves that are wired so that they may be opened when the compressor is energized can present problems under certain circumstances. When the compressor overheats, an internal temperature sensor cuts the electrical power to the motor. When this occurs, the solenoid valve may still be powered and thus the compressor will no longer operate but the valve will still be open allowing the liquid refrigerant to be bled to the compressor's enclosed spaces. The abundant presence of liquid refrigerant in the enclosed spaces will cause flooded starts upon re-start of the compressor, as stated above. Electrical means to prevent such situations are possible. For example, wiring the solenoid valve in series with the motor windings can provide such protection. Other alternatives include the sensing of the current in the motor winding and closing the valve when a current absence condition is sensed.

Accordingly, the continued development of liquid injection systems is directed to a low cost system which can position an injection port closer to the discharge passageway as well as being able to eliminate any problems encountered during startup of the compressor. The present invention provides the art with an injection system which utilizes an internal pilot valve to control the liquid injection system. The internal pilot valve operates in response to discharge pressure and will only allow liquid injection at a time when the discharge pressure is above a specified minimum.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
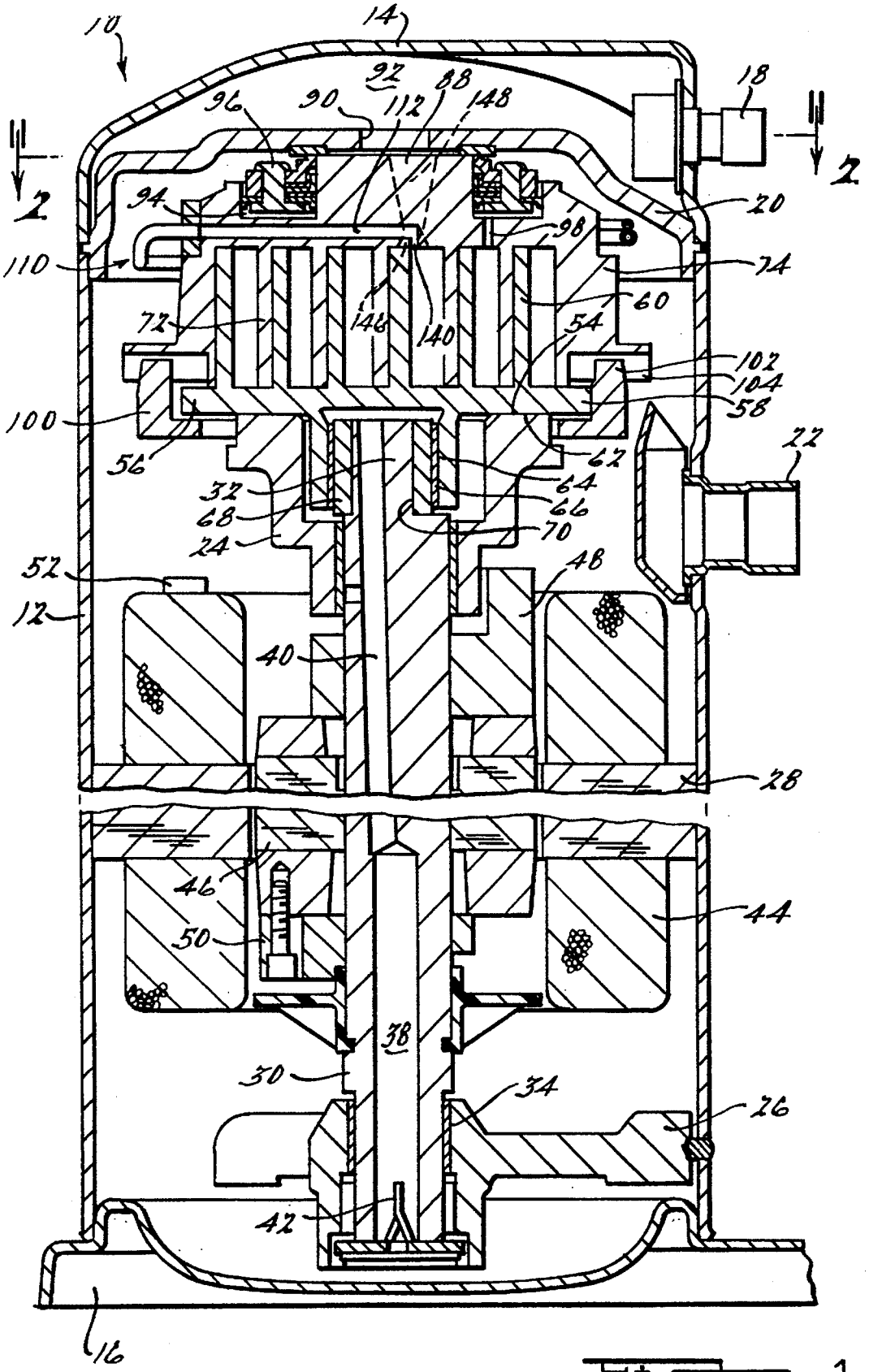
FIG. 1 is a vertical sectional view of a scroll compressor incorporating the unique liquid injection system of the present invention, taken along line 1—1 in FIG. 2.
Figure 2:
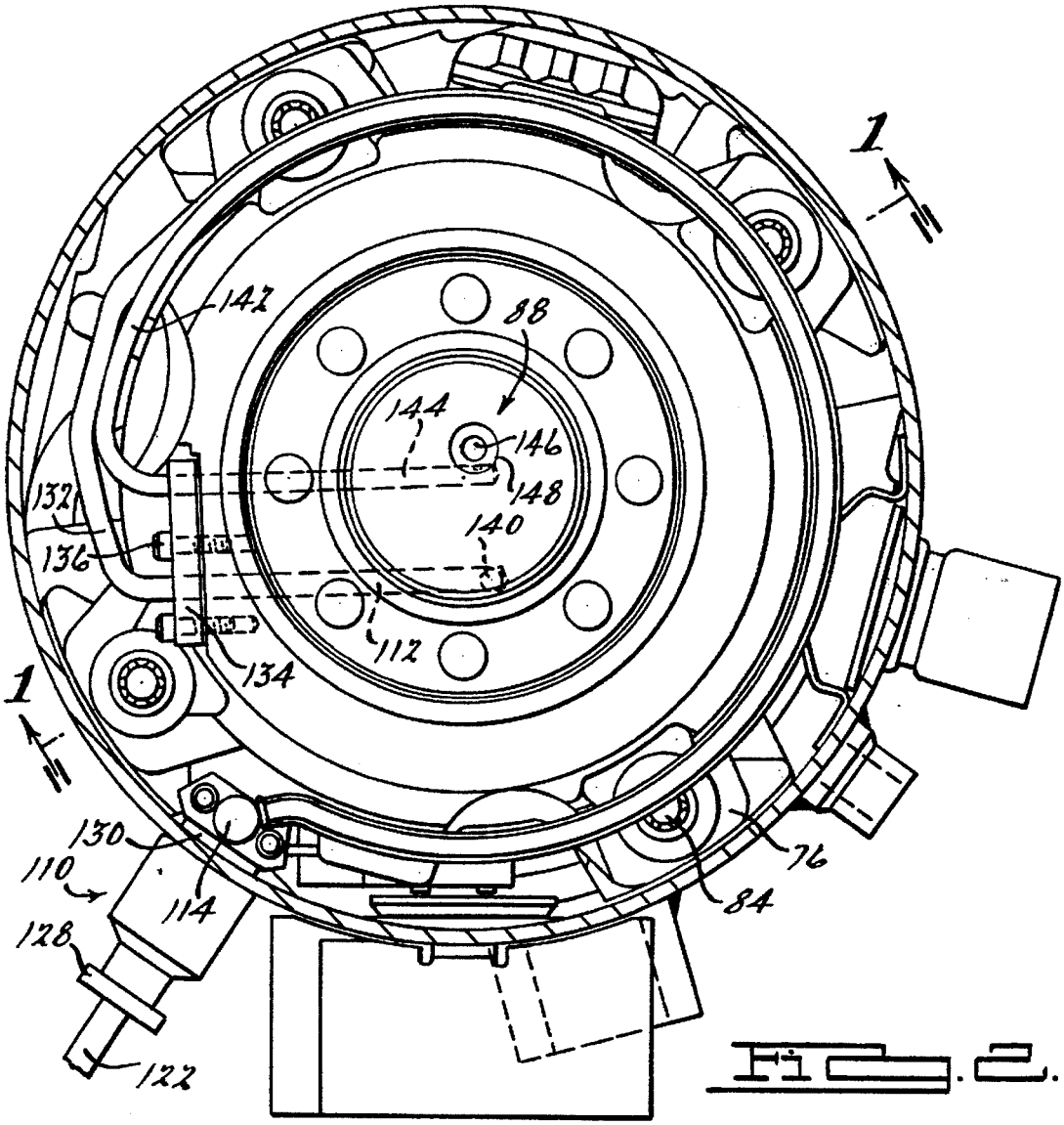
FIG. 2 is a horizontal sectional view of the scroll compressor of the present invention, taken along line 2—2 in FIG. 1.

Referring now to the drawings in which like reference numerals designate like or corresponding parts throughout the several views, there is shown in FIG. 1 a hermetic refrigeration scroll compressor incorporating the unique liquid injection system and which is identified generally by the reference numeral 10. Scroll compressor 10 comprises a generally cylindrical hermetic shell 12 having welded at the upper end thereof a cap 14 and at the lower end thereof a base 16 having a plurality of mounting feet (not shown) integrally formed therewith. Cap 14 is provided with a refrigerant discharge fitting 18 which may have the usual discharge valve therein (not shown). Other major elements affixed to shell 12 include a transversely extending partition 20 which is welded about its periphery at the same point cap 14 is welded to shell 12, an inlet fitting 22, a main bearing housing 24 which is suitably secured to shell 12 and a lower bearing housing 26 having a plurality of radially outwardly extending legs each of which is suitably secured to shell 12. A motor stator 28 which is generally square in cross-section but with the corners rounded off is press fit into shell 12. The flats between the rounded corners on stator 28 provide passageways between stator 28 and shell 12 which facilitate the return flow of lubricant from the top of shell 12 to its bottom.

A driveshaft or crankshaft 30 having an eccentric crank pin 32 at the upper end thereof is rotatable journaled in a bearing 34 in lower bearing housing 26. Crankshaft 30 has at the lower end a relatively large diameter concentric bore 38 which communicates with a radially outwardly located smaller diameter bore 40 extending upwardly therefrom to the top of crankshaft 30. Disposed within bore 38 is a stirrer 42. The lower portion of the interior of shell 12 is filled with lubricating oil and bore 38 and 40 act as a pump to pump the lubricating oil up crankshaft 30 and ultimately to all of the various portions of compressor 10 which require lubrication.

Crankshaft 30 is rotatively driven by an electric motor which includes motor stator 28 having windings 44 passing therethrough and a motor rotor 46 press fitted onto crankshaft 30 and having upper and lower counterweights 48 and 50, respectively. A motor protector 52, of the usual type, is provided in close proximity to motor windings 44 so that if the motor exceeds its normal temperature range, motor protector 52 will de-energize the motor.

The upper surface of main bearing housing 24 is provided with an annular flat thrust bearing surface 54 on which is disposed an orbiting scroll member 56. Scroll member 56 comprises an end plate 58 having the usual spiral vane or wrap 60 on the upper surface thereof and an annular flat thrust surface 62 on the lower surface thereof. Projecting downwardly from the lower surface is a cylindrical hub 64 having a journal bearing 66 therein and in which is rotatively disposed a drive bushing 68 having an inner bore 70 in which crank pin 32 is drivingly disposed. Crank pin 32 has a flat on one surface (not shown) which drivingly engages a flat surface in a portion of bore 70 (not shown) to provide a radially compliant drive arrangement such as shown in assignee's U.S. Pat. No. 4,877,382 the disclosure of which is incorporated herein by reference.

Figure 3:
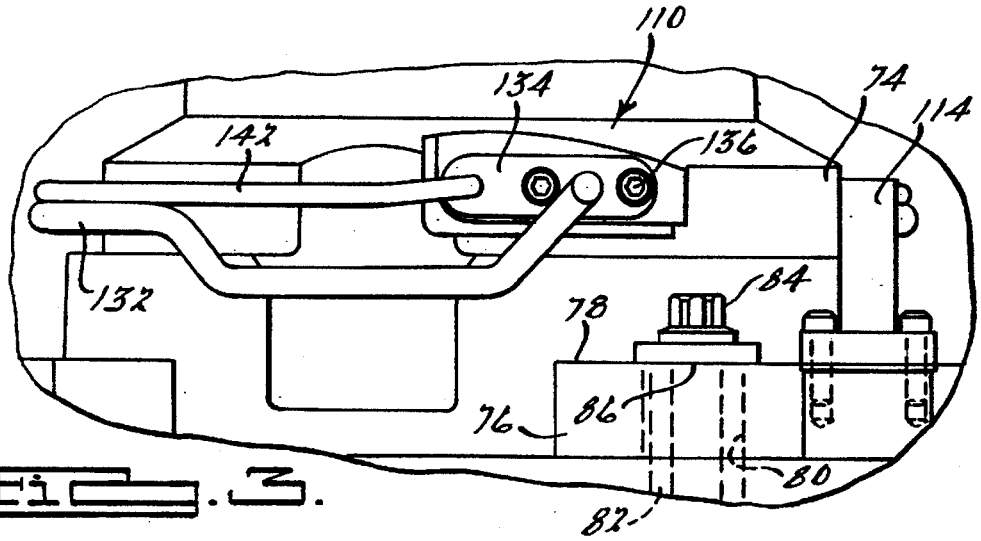
FIG. 3 is a vertical side view of the non-orbiting scroll of the scroll compressor shown in FIG. 1.

Wrap 60 meshes with a non-orbiting spiral wrap 72 forming part of a nonorbiting scroll member 74. Non-orbiting scroll member 74 is mounted to main bearing housing 24 in any desired manner which will provide limited axial movement on non-orbiting scroll member 74. The specific manner of such mounting is not critical to the present invention, however in the preferred embodiment, for exemplary purposes shown in FIG. 3, non-orbiting scroll member 74 has a plurality of circumferentially spaced mounting bosses 76 each having a flat upper surface 78 and an axial bore 80. A sleeve 82 is slidably disposed within bore 80 and sleeve 82 is bolted to main bearing housing 24 by a bolt 84. Bolt 84 has an enlarged head having a flat lower surface 86 which engages upper surface 78 to limit the axial upper or separating movement of non-orbiting scroll member 74. Movement of non-orbiting scroll member 74 in the opposite direction is limited by axial engagement of the lower tip surface of wrap 72 and the flat upper surface of orbiting scroll member 56.

Non-orbiting scroll member 74 has a centrally disposed discharge diffuser 88 which is in fluid communication via an opening 90 in partition 20 with a discharge muffler 92 defined by cap 14 and partition 20. Non-orbiting scroll member 74 has in the upper surface thereof an annular recess 94 having parallel coaxial side walls within which is sealingly disposed for relative axial movement an annular floating seal assembly 96 which serves to isolate the bottom of recess 94 so that it can be placed in fluid communication with a source of intermediate fluid pressure by means of a passageway 98. Non-orbiting scroll member 74 is thus axially biased against orbiting scroll member 56 by the forces created by discharge pressure acting on the central portion of non-orbiting scroll member 74 and the forces created by intermediate fluid pressure acting on the bottom of recess 94. This axial pressure biasing, as well as various techniques for supporting non-orbiting scroll member 74 for limited axial movement, are disclosed in much greater detail in assignee's aforementioned U.S. Pat. No. 4,877,382.

Relative rotation of scroll members 56 and 74 is prevented by the usual Oldham coupling comprising a ring 100 having a first pair of keys 102 slidably disposed in diametrically opposed slots 104 in non-orbiting scroll member 74 and a second pair of keys (not shown) slidably disposed in diametrically opposed slots (not shown) in scroll member 56.

Compressor 10 is preferably of the "low side" type in which suction gas entering shell 12 is allowed, in part, to assist in cooling the motor. So long as there is an adequate flow of returning suction gas, the motor will remain within the desired temperature limits. When this flow ceases, however, the loss of cooling will cause motor protector 52 to trip and shut compressor 10 down.

The scroll compressor, as thus broadly described, is either now known in the art or is the subject matter of other pending applications for patent by Applicant's assignee. The details of construction which incorporates the principles of the present invention are those which deal with a unique liquid injection system identified generally by reference numeral 110.

The preferred embodiment of liquid injection system 110 provides a unique arrangement including a liquid injection passage 112 in combination with discharge diffuser 88. Discharge diffuser 88 provides the benefit of reducing the fluid pressure within the successive enclosed spaces. This pressure reduction enables positive liquid injection to occur closer to discharge diffuser 88 or at a more central position and thus at a later time in the orbiting motion cycle without the need of a dynamic discharge valve which closes during each cycle or a pump or other device for altering the flow of the liquid refrigerant to be injected. The liquid refrigerant is therefore injected closer to the discharge passage where the working fluid is hottest and where the liquid refrigerant cools the working fluid more effectively. In addition, liquid injection system 110 further includes a unique internal valve 114, shown in FIGS. 2 through 5, which selectively opens and closes the supply of liquid refrigerant in response to the various pressures of refrigerant in compressor 10. Prior art liquid injection systems have utilized a solenoid valve for selectively blocking the source of liquid refrigerant when the refrigeration cycle is shut off. While the solenoid works well when the refrigeration cycle is shut off, when compressor 10 is shut down due to de-energization of the motor by motor protector 52, the solenoid valve will remain open and allow liquid refrigerant to flow into the enclosed spaces. When motor protector 52 resets, compressor 10 will go through a flooded start due to the solenoid remaining open. Internal valve 114 eliminates this problem by being responsive to the pressure difference between discharge pressure and the pressure of refrigerant at the outlet of the condensor which is a direct indicator of the flow of refrigerant through the condensor and therefore an indicator of the operation of compressor 10.

Figure 11:
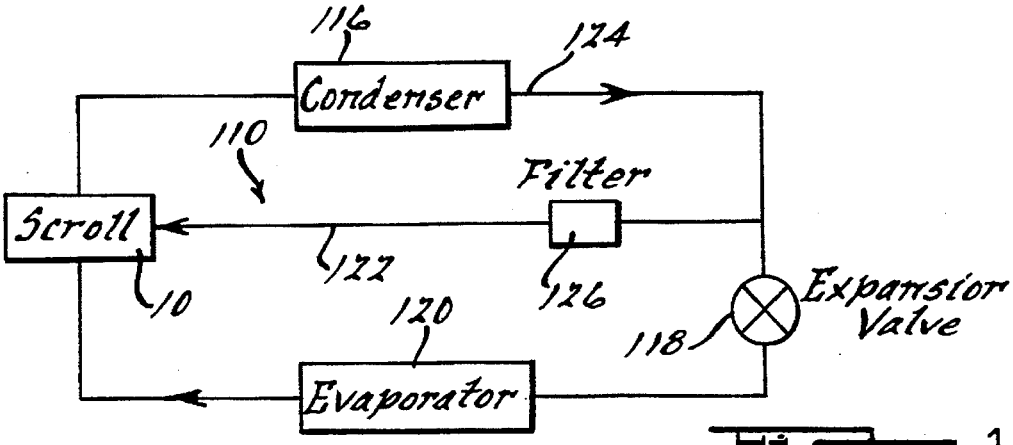
FIG. 11 is a schematic illustration of a refrigeration system incorporating the liquid injection system according to the present invention.

The novel liquid injection system 110 of the present invention is shown in diagrammatic form in FIG. 11. FIG. 11 illustrates a refrigeration cycle having scroll compressor 10, a condenser 116, an expansion valve 118 and an evaporator 120. These elements are coupled in series to form a continuous loop through which a working fluid refrigerant flows. Scroll compressor 10 compresses the refrigerant in a gaseous state and condenser 116 condenses the gaseous refrigerant to a liquid state, a portion of which is then injected into scroll compressor 10 by liquid injection system 110. Liquid injection system 110 incorporates an injection path defined by a tubular member 122 extending from an outlet 124 of condenser 116, through a filter 126, and into an enclosed space defined by scroll members 56 and 74. Now referring to FIG. 2, liquid refrigerant flows from tubular member 122 into a connector 128 which passes through shell 12 and is coupled to a mounting plate 130 to which valve 114 is mounted. A second tubular member 132 extends between valve 114 and is coupled to a mounting plate 134 having a gasket (not shown) and fixedly secured to non-orbiting scroll member 74 using a plurality of bolts 136. Mounting plate 134 couples second tubular member 132 with liquid injection passage 112 formed through the end plate of non-orbiting scroll member 74. Liquid injection passage 112 extends to a liquid injection port 140 formed on the inner face of the end plate of non-orbiting scroll member 74. A third tubular member 142 extends between valve 114 and is coupled to mounting plate 134 which couples third tubular member 142 with a discharge pressure fluid passage 144 formed through the end plate of non-orbiting scroll member 74. Thus, valve 114 is placed within the flow path of liquid refrigerant and is also provided with a source of fluid at discharge pressure. Tubular members 132 and 142 are preferably formed of a flexible material, such as copper tubing, to allow for the axial compliant mounting arrangement for non-orbiting scroll member 74. The range of axial motion for non-orbiting scroll member 74 is relatively small, so that a more complicated flexible coupling is not required for tubular members 132 and 142.

To encourage positive liquid injection, the pressure of the liquid refrigerant at condensor outlet 124 should be greater, for at least a portion of the cycle of orbiting motion, than the pressure of the gaseous refrigerant within an enclosed space which is in fluid communication with liquid injection port 140. Such a positive pressure differential preferably enables liquid injection system 110 to inject liquid without the assistance of a liquid pump or other device for altering pressure or influencing flow. Diffuser 88 encourages positive liquid injection at a later time in the orbiting motion cycle because it reduces the pressure of the gaseous refrigerant until that later time in the orbiting motion cycle.

The location of injection port 140 on the end plate of non-orbiting scroll member 74 is very important. It is desirable that injection port 140 be located along an inner wall of scroll wrap 72 of non-orbiting scroll member 74 as centrally (i.e. nearer to discharge diffuser 88) as possible, in order to be more thermodynamically effective in cooling the working fluid in the enclosed spaces. However, if injection port 140 were located too deeply within spiral wrap 72, then the pressure within the enclosed space would be too high for too great a portion of each cycle of orbiting motion. Locating injection port 140 too deeply would therefore cause either an insufficient amount of liquid injection for effective cooling of the working fluid, or might even cause reverse flow. On the other hand, if injection port 140 were located at a position which is located too far radially outward, then an excessive amount of liquid refrigerant would be injected into the enclose space. In addition, locating injection port too far radially outward would result in unbalanced operation of scroll compressor 10.

Injection port 140 is therefore preferably disposed as centrally as possible on the end plate of non-orbiting scroll member 74 to enable a sufficient volume of liquid refrigerant injection. Moreover, operation of scroll compressor 10 and liquid injection system 110 with injection port 140 located as centrally as possible allows liquid injection system 110 to inject liquid refrigerant into two separate enclosed spaces during one cycle of orbiting motion. As a result, liquid injection system 110 can inject liquid into a first enclosed space at one time in the cycle of orbiting motion when this first enclosed space is open to discharge diffuser 88 and into a second enclosed space at a second time in the cycle when this second enclosed space is closed off from discharge diffuser 88. Injection port 140 is of course shut off by spiral wrap 60 of orbiting scroll member 56 for a portion of the orbiting motion cycle.

The novel liquid injection system 110 of the present invention is preferably used in conjunction with discharge diffuser 88 to improve the discharge flow and operating efficiency of the scroll machine which has been described thus far. Discharge diffuser 88 has been discovered to provide a more efficient flow passage for the pressurized refrigerant gas. Diffuser 88 preferably has a converging entrance portion and a diverging exit portion disposed between an entrance port 146 and an exit port 148. In an ideal diffuser, in its simplest form, the cross-sectional area of the passage should progressively decrease throughout the converging entrance portion and progressively increase throughout the diverging portion of diffuser 88 in a forward or discharge flow direction. Diffuser 88 should also be formed with a smooth entrance, throat, and exit. Exit port 148 of diffuser 88 communicates with discharge muffler 92 via opening 90 in partition 20.

Regardless of the particular configuration of diffuser 88, the cross-sectional shape of diffuser 88 is preferably circular. Moreover, the included angle of the diverging portion is preferably in the range of 5 to 20 degrees, and ideally is approximately 7 to 15 degrees, depending on its axial length. The length of diffuser 88 should preferably be as short as possible with respect to the diameter of exit port 148 to minimize friction loss while insuring as large an exit opening as possible so as to decrease the kinetic energy of the gas lost upon exit.

Discharge diffuser 88 is adapted to reduce the pressure in the innermost enclosed space below what it would be if the compressor were equipped with a conventional discharge passage. Diffuser 88 provides for minimum forward pressure losses, while it is believed to increase the efficiency and reliability of the compressor, especially at relatively high pressure ratios.

It is also believed that the diffuser 88 of the present invention tends to restrict reverse flow from discharge muffler 92 and into the most central enclosed space of scroll wraps 60 and 72 because the flow may tend to choke in the reverse flow direction. As a result, the working fluid in the most central enclosed space will experience an increased pressure fluctuation during each cycle of orbiting motion.

Accordingly, working fluid contained in discharge muffler 92 may tend not to reverse flow into the innermost enclosed space and thus not to equalize the pressures between discharge muffler 92 and the innermost enclosed space. The pressure in the innermost enclosed space is reduced below the pressure it would be without discharge diffuser 88, preferably below the supply pressure at the outlet 124 of condenser 116 at a later time in the orbiting motion cycle. Because of the resulting positive pressure gradient, positive liquid injection is caused to flow through port 140. This reduction in pressure may occur immediately after spiral wrap 60 crosses discharge diffuser 88 or after the wrap tips separate. The pressure reduction thus enables injection port 140 to be disposed in a more central location while maintaining adequate liquid injection performance. In other words, liquid injection can occur at a more central location, and at a later time in each cycle of orbiting motion, than would be possible without diffuser 88 and the pressure reduction. Liquid injection system 110 is thus preferably capable of injection liquid at a time during the cycle of orbiting motion when the innermost enclosed space is open to, or in fluid communication with, discharge diffuser 88. The pressure reduction may thus enable the liquid injection system to inject liquid during a discharge portion of the cycle of orbiting motion, when the working fluid is being discharged through discharge diffuser 88.

Indeed, the present invention requires no valve associated with discharge diffuser 88 in order to cause the pressure reduction, and discharge diffuser 88 remains open in fluid communication with discharge muffler 92 throughout each cycle of orbiting motion. Fluid communication refers to a condition in which a path exists by which fluid might flow. In other words, discharge diffuser 88 is preferably not physically blocked off at any time in an operating cycle from discharge muffler 92. Likewise, the condition of being out of fluid communication means that no such path exists, or that fluid flow is physically closed off.

As stated above, liquid injection system 110 could include a solenoid valve to selectively block the flow of liquid refrigerant when the refrigerant system is shut off. In place of a solenoid valve, liquid injection system 110 includes internal valve 114 to selectively block the flow of liquid refrigerant in response to the presence of discharge pressure of compressor 10.

Figure 4:
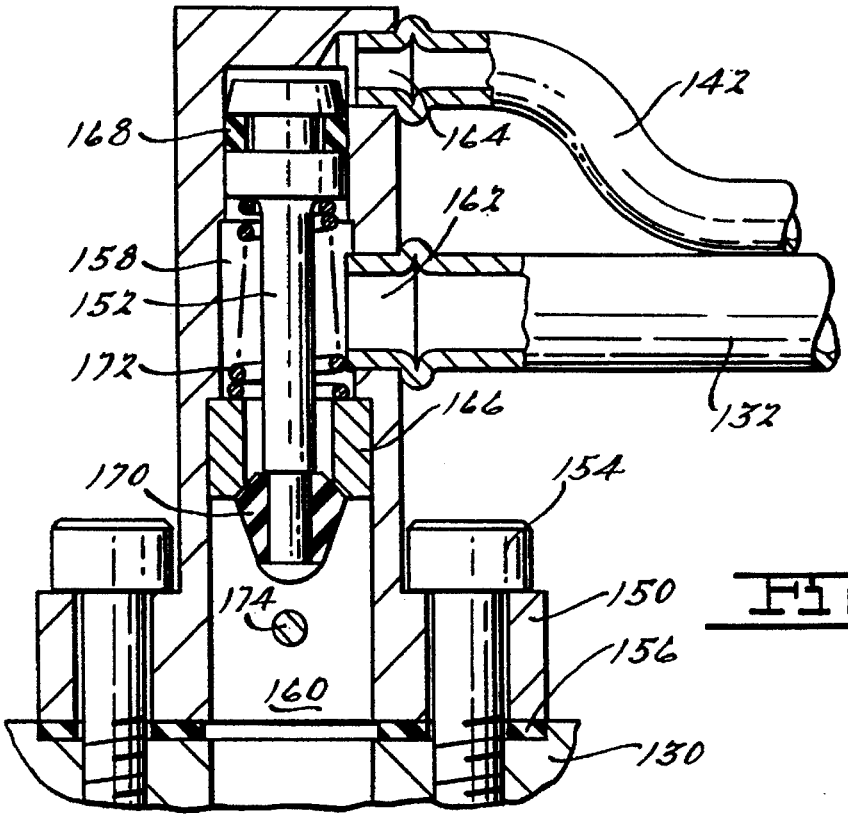
FIG. 4 is a vertical cross-sectional view of the unique internal pilot valve of the present invention with the valve closed.
Figure 5:
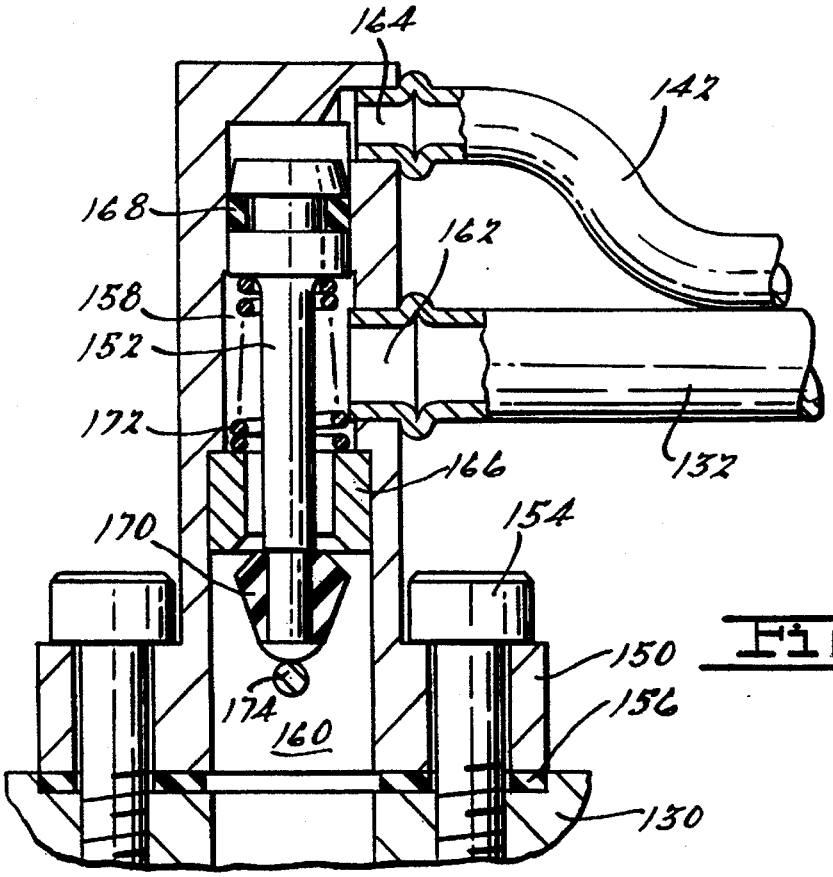
FIG. 5 is a vertical sectional view of the unique internal pilot valve of the present invention with the valve open.
Figure 6:
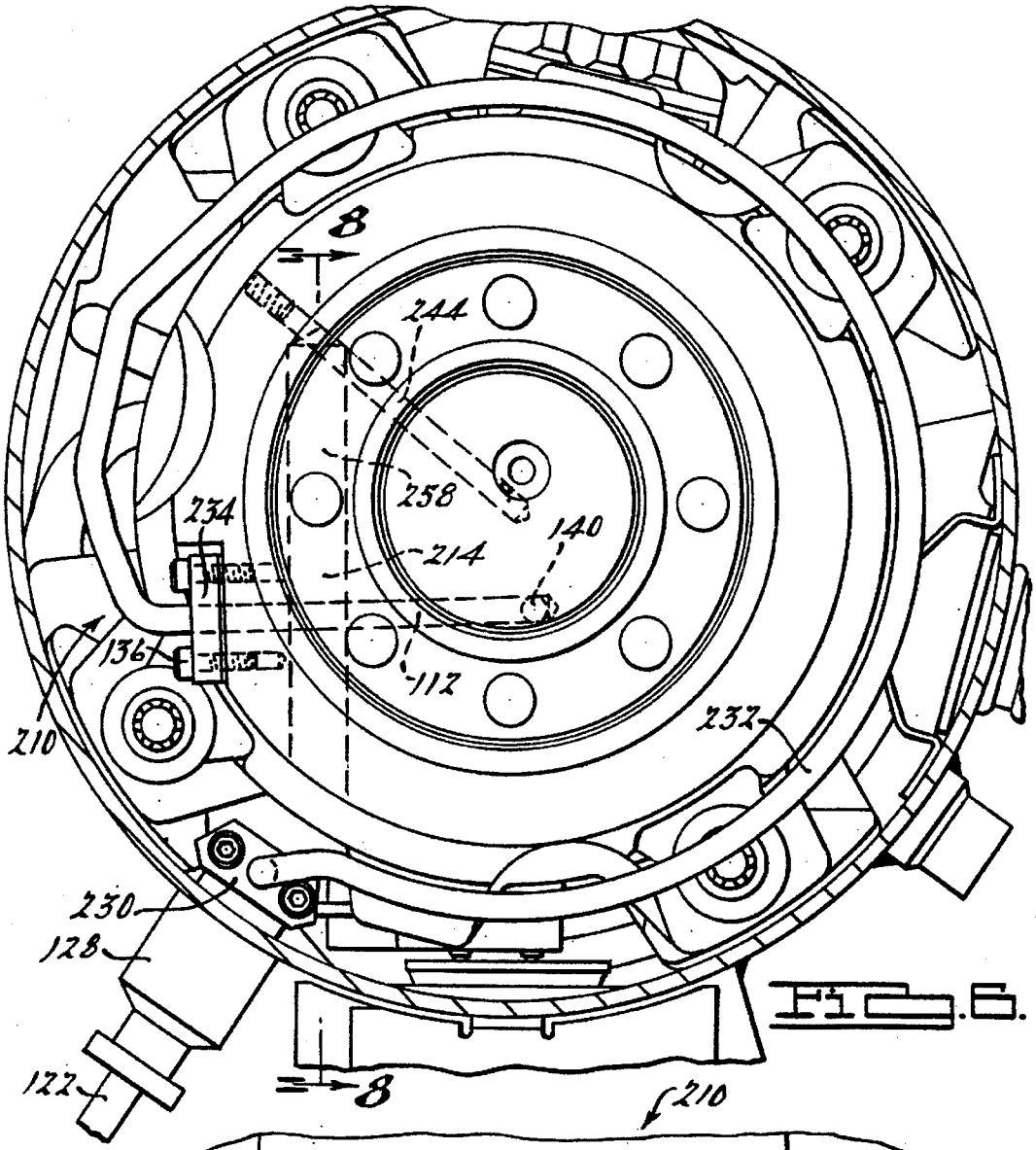
FIG. 6 is a view similar to FIG. 2 but showing another embodiment of the unique internal pilot valve according to the present invention.
Figure 7:
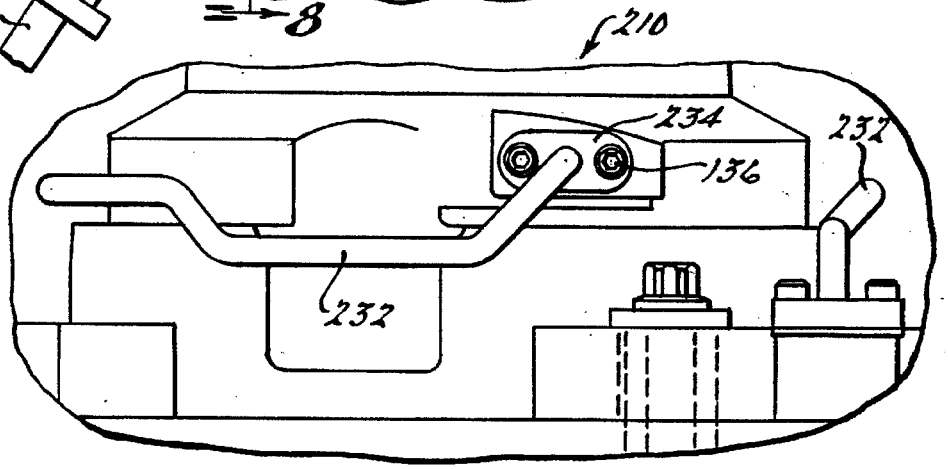
FIG. 7 is a vertical side view of the non-orbiting scroll of the embodiment shown in FIG. 6.
Figure 8:
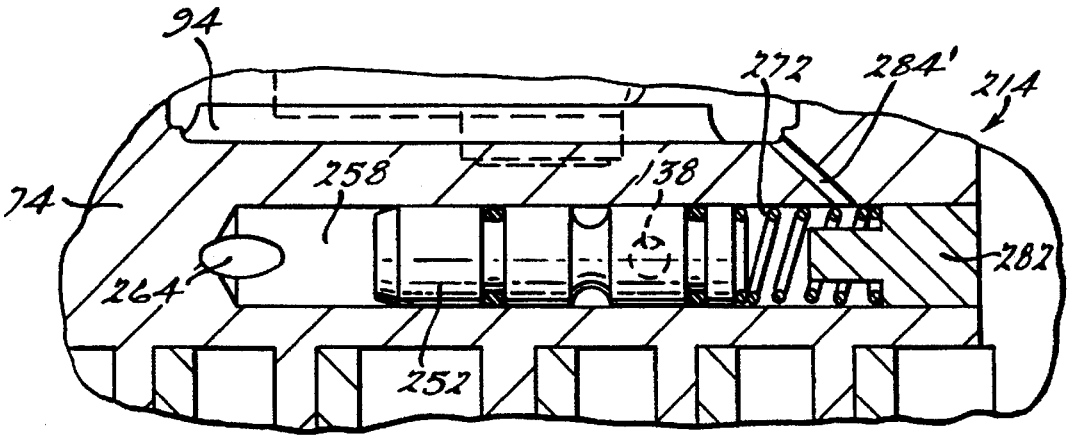
FIG. 8 is a vertical cross-sectional view of the unique internal pilot valve shown in FIG. 6, taken along line 8—8 in FIG. 6 with the valve shown in the closed position.

Referring now to FIGS. 4 and 5, internal valve 114 comprises a housing 150 and a piston 152. Housing 150 is fixedly secured to mounting plate 130 by a plurality of bolts 154 using a gasket 156. Housing 150 defines an internal chamber 158 having a liquid refrigerant inlet 160, a liquid refrigerant outlet 162 and a discharge fluid inlet 164. Inlet 160 is in fluid communication with tubular member 122 through mounting plate 130 and connector 128. Outlet 162 is in fluid communication with tubular member 132 and inlet 164 is in fluid communication with tubular member 142. A valve seat 166 is fixedly secured to housing 150 within chamber 158.

Piston 152 slidingly engages the internal walls of chamber 158 and incorporates a seal 168 to seal inlet 164 from outlet 162. Piston 152 extends from the upper portion of chamber 158 through valve seat 166 and into the lower portion of chamber 158 where a seal member 170 is secured to piston 152 such that seal member 170 mates with valve seat 166. A coil spring 172 extends between valve seat 166 and piston 152 to urge piston 152 upward as shown in FIG. 4 such that seal member 170 is urged against valve seat 166. In this position, which is the normally closed position for valve 114, liquid refrigerant flow between inlet 160 and outlet 162 is blocked. Valve 114 is in this normally closed position, as shown in FIG. 4, when compressor 10 is not operating due to the lack of pressure difference between discharge at inlet 164 and the liquid refrigerant pressure at the outlet of the condensor at inlet 160.

When compressor 10 begins to operate, fluid at discharge pressure will be supplied to inlet 164 through tubular member 142 and discharge pressure fluid passage 144. The fluid at discharge pressure will act against piston 152 to move piston 152 downward as shown in FIG. 5 to unseat seal member 170 from valve seat 166 and open valve 114 by allowing liquid refrigerant flow form inlet 160 to outlet 162. A retaining pin 174 extends into chamber 158 to limit the axial movement of piston 152. In this open position, liquid refrigerant is allowed to flow from outlet 124 through tubular member 122 and filter 126 into connector 128. From connector 128, liquid refrigerant flow through mounting plate 130, through valve 114, through tubular member 132, through liquid injection passage 112 and finally into the enclosed spaces defined by scroll wraps 60 and 72 through injection port 140. Liquid refrigerant flow will continue until compressor 10 stops thus no longer supplying discharge pressurized fluid to inlet 164 and coil spring 172 again closes valve 114. Thus, the flow of liquid refrigerant is selectively controlled by the presence of a pressure difference between the discharge pressure and the pressure of the liquid refrigerant within compressor 10.

FIGS. 6 through 10 illustrate additional embodiments of the liquid injection system in accordance with the present invention which is designated generally by the reference numeral 210. Liquid injection system 210 is similar to liquid injection system 110 except that internal valve 114 is replaced by integral valve 214.

Integral valve 214 comprises a piston 252 which is slidably received within an internal chamber 258 located directly within non-orbiting scroll member 74. Chamber 258 includes a liquid refrigerant inlet 260, a liquid refrigerant outlet 262 and a discharge fluid inlet 264. Inlet 260 is in fluid communication with outlet 124 and tubular member 122 through a tubular member 232 which extends between a mounting plate 230 and a mounting plate 234. Mounting plate 230 is coupled to connector 128 while mounting plate 234 is fixedly secured to non-orbiting scroll member 74 using the plurality of bolts 136. Mounting plate 234 couples tubular member 232 with liquid injection passage 112 formed through the end plate of non-orbiting scroll member 74. Liquid injection passage 112 extends to liquid injection port 140 formed on the inner face of the end plate of non-orbiting scroll member 74 and liquid injection port 140 operates as described above for liquid injection system 110. Tubular member 232 is also preferably formed of a flexible material such as copper tubing to allow for the axial compliant mounting arrangement of non-orbiting scroll member 74.

Internal chamber 258 extends into the end plate of non-orbiting scroll member 74 to intersect with liquid injection passage 112 to form inlet 260 and outlet 262. Chamber 258 also intersects with a discharge fluid passageway 244 which is in communication with discharge diffuser 88 to form inlet 264. The opposite end of passageway 244 is closed off using a plug 280. Thus valve 214 is placed within the flow path of liquid refrigerant and is also provided with a source of fluid at discharge pressure.

Piston 252 is slidingly received within chamber 258 and once positioned within chamber 258, a plug 282 is secured within the open end of chamber 258 to retain piston 252. In the embodiment shown in FIG. 9, Plug 282 defines a vent hole 284 which allows for the free movement of piston 252 within chamber 258. Vent hole 284 is open to the suction pressure zone of the compressor and thus provides suction pressure to the back side of piston 252. This exposure to suction pressure allows the movement of piston 252 to be in response to the pressure difference between discharge and suction pressures which is indicative of the operation of the compressor. Another embodiment of the present invention is illustrated int FIG. 8 where the back side of piston 252 is exposed to an intermediate pressure through a vent hole 284' which extends between chamber 258 and recess 94 which contains floating seal assembly 96. In this embodiment, the movement of piston 252 is controlled by the pressures ratio between discharge and suction pressure. This embodiment provides a closer correlation between the injection of liquid refrigerant and the pressure ratio and thus it can more closely control the protection against excess temperatures. A coil spring 272 biases piston 252 away from plug 282. Piston 252 includes a first seal 268 to seal inlet 260 and outlet 262 from inlet 264 and second seal 288 to seal inlet 260 and outlet 262 from the suction zone of compressor 10.

Figure 9:
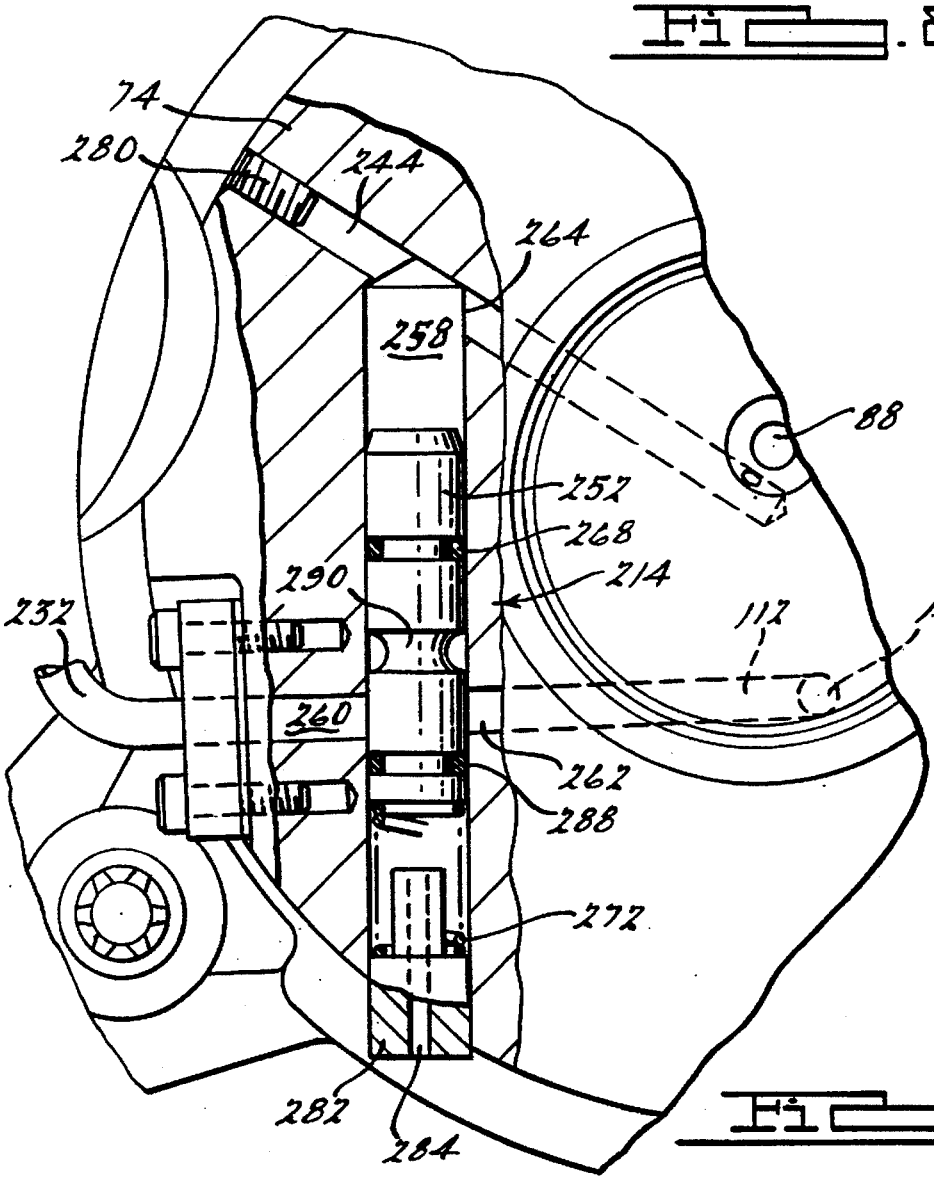
FIG. 9 is an enlarged plan view, partially in cross-section, of the internal pilot valve shown in FIG. 6 in the closed position.
Figure 10:
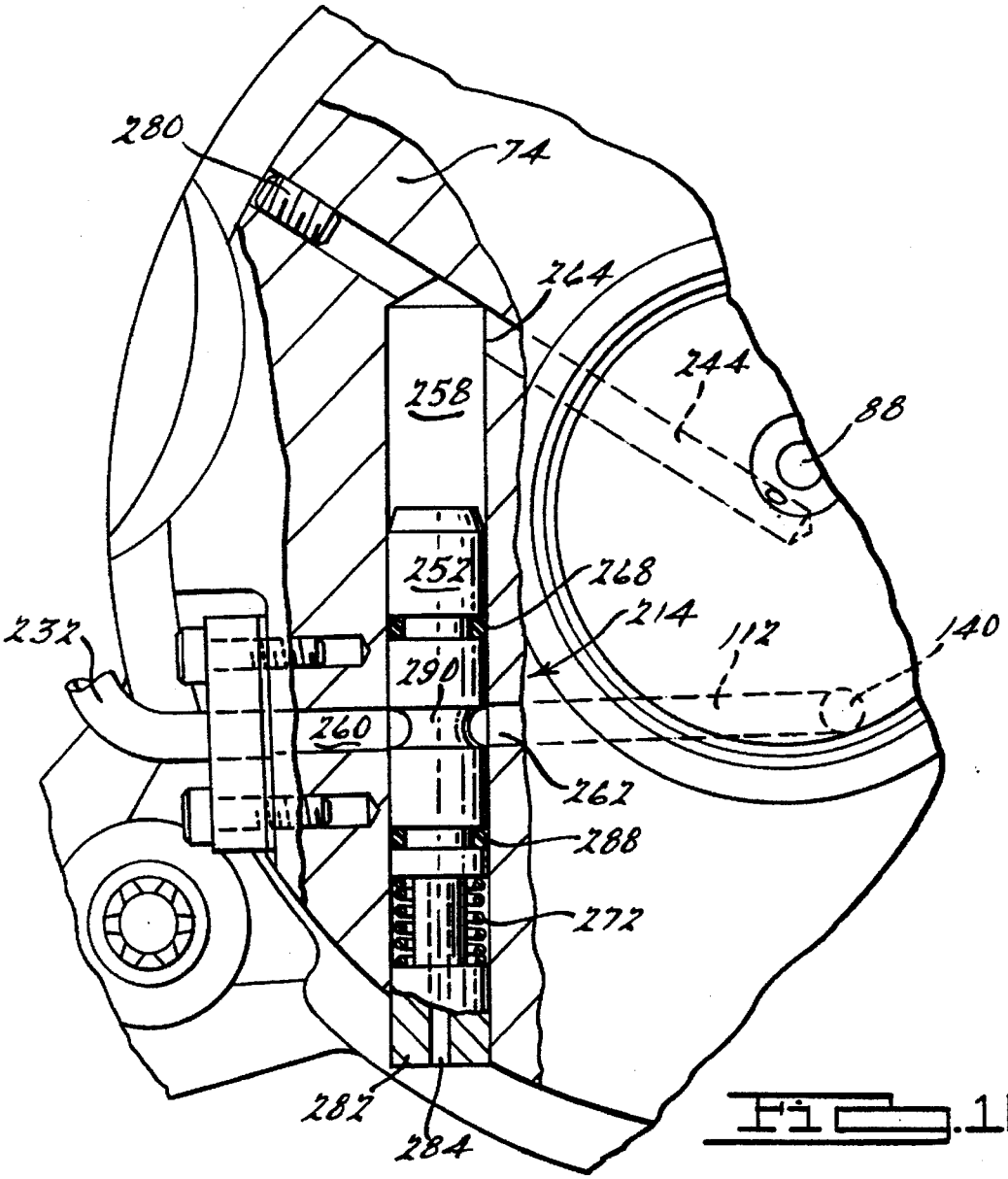
FIG. 10 is an enlarged plan view, partially in cross-section, of the internal pilot valve shown in FIG. 6 in the open position.

Piston 252 is movable between a first position shown in FIG. 9 where valve 214 is closed and a second position shown in FIG. 10 where valve 214 is open. Valve 214 is normally in the closed position shown in FIG. 9 due to the biasing of piston 252 away from plug 282. In this position, liquid refrigerant flow is blocked due to the body of piston 252 being positioned between, and thus blocking, inlet 260 and outlet 262.

When compressor 10 begins to operate, fluid at discharge pressure will be supplied to inlet 264. The various pressurized fluids will act against both ends of piston 252. The movement of piston 252 will be controlled by the fluid pressures present at each end of piston 252 and the strength of coil spring 272. When discharge pressure supplied through inlet 264 overcomes the pressurized fluid on the opposite end of piston 252 and the load of spring 272, piston 252 will move to the position shown in FIG. 10. In this position, an annular groove 290 is aligned with inlet 260 and outlet 262 to open valve 214. Annular groove 290 allows liquid refrigerant to flow from inlet 260 to outlet 262. Piston 252 seats against plug 282 to insure that groove 290 will be in alignment with inlet 260 and outlet 262. In this open position, liquid refrigerant is allowed to flow from outlet 124 through tubular member 122 and filter 126 into connector 128. From connector 128, liquid refrigerant flows through mounting plate 230, through tubular member 232, through valve 214, through liquid injection passage 112 and finally into the enclosed spaces defined by wraps 60 and 72 through injection port 140. Liquid refrigerant flow will continue until compressor 10 stops thus no longer supplying discharge pressurized fluid to inlet 264. Thus the flow of liquid refrigerant is selectively controlled by the pressurized refrigerant generated by the operation of compressor 10. In one embodiment the flow is controlled by the pressure ratio of the compressor which is indicative of a condition that causes high discharge temperature.

While the above detailed description describes the preferred embodiment of the present invention, it should be understood that the present invention is susceptible to modification, variation and alteration without deviating from the scope and fair meaning of the subjoined claims.

What is claimed is:

1. A compressor having a compressor cycle for compressing a working fluid, said compressor including a hermetic shell and defining at least one enclosed space and a discharge space; and a liquid injection system for selectively supplying a liquid to said enclosed space of said compressor during one portion of said compressor cycle and to said discharge space at a different portion of said compressor cycle, said liquid injection system including a valve disposed within said hermetic shell which operates in response to a pressurized fluid.

2. The compressor according to claim 1 wherein, said pressurized fluid is said working fluid of said compressor.

3. The compressor according to claim 1 wherein, said valve is disposed within a component of said compressor.

4. The compressor according to claim 1 wherein, said liquid is said working fluid of said compressor.

5. The compressor according to claim 1 wherein, said compressor compresses said working fluid from a suction pressure to a discharge pressure, said valve operating in response to a pressure difference between said discharge pressure and said suction pressure.

6. The compressor according to claim 1 wherein, said compressor compresses said working fluid from a suction pressure to a discharge pressure, said valve operating in response to a pressure ratio defined by said discharge pressure and an intermediate pressure between said suction and discharge pressures.

7. A refrigeration system comprising:

a compressor having a compressor cycle for compressing a working fluid, said compressor including a hermetic shell and defining at least one enclosed space and a discharge space;

a condenser;

an evaporator;

a conduit interconnecting said compressor, said condenser and said evaporator in a closed loop series relationship;

a liquid injection conduit connected to said conduit between said condenser and said evaporator, said liquid injection conduit having an outlet open into said enclosed space of said compressor during one portion of said compressor and open into said discharge space at a different portion of said compressor cycle; and a valve disposed within said hermetic shell and within said liquid injection conduit for controlling the flow of liquid therethrough, said valve operating in response to a pressurized fluid.

8. The refrigeration system according to claim 7 wherein, said pressurized fluid is said working fluid of said compressor.

9. The refrigeration system according to claim 7 wherein, said valve is disposed within a component of said compressor.

10. The refrigeration system according to claim 7 wherein, said compressor compresses said working fluid from a suction pressure to a discharge pressure, said valve operating in response to a pressure difference between said discharge pressure and said suction pressure.

11. The refrigeration system according to claim 7 wherein, said compressor compresses said working fluid from a suction pressure to a discharge pressure, said valve operating in response to a pressure ratio defined by said discharge pressure and an intermediate pressure between said suction and discharge pressures.

12. A scroll-type compressor having a compressor cycle for handling a working fluid, said compressor including a hermetic shell and comprising:

first and second scroll members having intermeshed spiral wraps;

a drive mechanism for causing said scroll members to engage in cyclical relative orbiting motion, said spiral wraps forming successive enclosed spaces which move during normal operation from a radially outer position where said working fluid is at a suction pressure to a radially inner central position where said working fluid is at a higher central pressure;

a liquid injection circuit for injecting a liquid into at least one of said enclosed spaces during one portion of said compressor cycle and into said radially inner central position during a different portion of said compressor cycle to reduce the temperature of said working fluid, said liquid injection circuit including an injection passage extending from a liquid supply member to an injection port formed in one of said scroll members; and a valve disposed within said hermetic shell and within said injection passage to control the flow of said liquid therethrough, said valve operating in response to a pressurized fluid.

13. The scroll-type compressor according to claim 12 wherein, said pressurized fluid is said working fluid of said compressor.

14. The scroll-type compressor according to claim 12 wherein, said liquid is said working fluid of said scroll-type compressor.

15. The scroll-type compressor according to claim 12 wherein, said valve is responsive to said higher central pressure of said scroll-type compressor.

16. The scroll-type compressor according to claim 12 wherein, said valve is disposed within one of said first and second scroll members.

17. The scroll-type compressor according to claim 16 wherein, said valve is responsive to said higher central pressure of said scroll-type compressor.

18. The scroll-type compressor according to claim 12 wherein, said compressor compresses said working fluid from said suction pressure to said central pressure, said valve operating in response to a pressure difference between said central pressure and said suction pressure.

19. The scroll-type compressor according to claim 12 wherein, said compressor compresses said working fluid from said suction pressure to said central pressure, said valve operating in response to a pressure ratio defined by said central pressure and an intermediate pressure between said suction and central pressures.

20. A refrigeration system comprising:

a scroll-type compressor including a hermetic shell having a compressor cycle for handling a working fluid, said scroll-type compressor having first and second scroll members interleaved, said first scroll member being adapted to orbit relative to said second scroll member so as to define a plurality of enclosed spaces which decrease in volume as they move toward the center of said scroll members to form a discharge space, one of said first and second scroll members having a central discharge passage leading from said discharge space to a discharge chamber;

a condenser;

an evaporator;

a conduit interconnecting said scroll-type compressor, said condenser and said evaporator in a closed loop series relationship;

a liquid injection conduit connected to said conduit between said condenser and said evaporator, said liquid injection conduit having an outlet opening into one of said plurality of enclosed spaces during one portion of said compressor cycle and to said discharge space during a different portion of said compressor cycle; and a valve disposed within said hermetic shell and within said liquid injection conduit for controlling flow of liquid therethrough, said valve operating in response to a pressurized fluid.

21. The refrigeration system according to claim 20 wherein, said pressurized fluid is said working fluid of said compressor.

22. The refrigeration system according to claim 20 wherein, said valve is responsive to said higher central pressure of said scroll-type compressor.

23. The refrigeration system according to claim 20 wherein, said valve is disposed within one of said first and second scroll members.

24. The refrigeration system according to claim 23 wherein, said valve is responsive to said higher central pressure of said scroll-type compressor.

25. The refrigeration system according to claim 20 wherein, said compressor compresses said working fluid from a suction pressure to a discharge pressure, said valve operating in response to a pressure difference between said discharge pressure and said suction pressure.

26. The refrigeration system according to claim 20 wherein, said compressor compresses said working fluid from a suction pressure to a discharge pressure, said valve operating in response to a pressure ratio defined by said discharge pressure and an intermediate pressure between said suction and discharge pressures.

27. A compressor having a compressor cycle for compressing a working fluid from a suction pressure to a discharge pressure, said compressor defining at least one enclosed space and a discharge space; and a liquid injection system for selectively supplying a liquid to said enclosed space of said compressor during one portion of said compressor cycle and to said discharge space at a different portion of said compressor cycle, said liquid injection system including a valve which operates in response to a pressure difference between said discharge pressure and said suction pressure.

28. A compressor having a compressor cycle for compressing a working fluid from a suction pressure to a discharge pressure, said compressor defining at least one enclosed space and a discharge space; and a liquid injection system for selectively supplying a liquid to said enclosed space of said compressor during one portion of said compressor cycle and to said discharge space at a different portion of said compressor cycle, said liquid injection system including a valve which operates in response to a pressure ratio defined by said discharge pressure and an intermediate pressure between said suction and discharge pressures.

29. A refrigeration system comprising:

a compressor having a compressor cycle for compressing a working fluid from a suction pressure to a discharge pressure, said compressor defining at least one enclosed space and a discharge space;

a condenser;

an evaporator;

a conduit interconnecting said compressor, said condenser and said evaporator in a closed loop series relationship;

a liquid injection conduit connected to said conduit between said condenser and said evaporator, said liquid injection conduit having an outlet open into said enclosed space of said compressor during one portion of said compressor and open into said discharge space at a different portion of said compressor cycle; and a valve disposed within said liquid injection conduit for controlling the flow of liquid therethrough, said valve operating in response to a pressure difference between said discharge pressure and said suction pressure.

30. a refrigeration system comprising:

a compressor having a compressor cycle for compressing a working fluid from a suction pressure to a discharge pressure, said compressor defining at least one enclosed space and a discharge space;

a condenser;

an evaporator;

a conduit interconnecting said compressor, said condenser and said evaporator in a closed loop series relationship;

a liquid injection conduit connected to said conduit between said condenser and said evaporator, said liquid injection conduit having an outlet open into said enclosed space of said compressor during one portion of said compressor and open into said discharge space at a different portion of said compressor cycle; and a valve disposed within said liquid injection conduit for controlling the flow of liquid therethrough, said valve operating in response to a pressure ratio defined by said discharge pressure and an intermediate pressure between said suction and discharge pressures.

31. A scroll-type compressor having a compressor cycle for handling a working fluid, said compressor compressing said working fluid between a suction pressure and a discharge pressure, said compressor comprising:

first and second scroll members having intermeshed spiral wraps;

a drive mechanism for causing said scroll members to engage in cyclical relative orbiting motion, said spiral wraps forming successive enclosed spaces which move during normal operation from a radially outer position where said working fluid is at a suction pressure to a radially inner central position where said working fluid is at a higher central pressure;

a liquid injection circuit for injecting a liquid into at least one of said enclosed spaces during one portion of said compressor cycle and into said radially inner central position during a different portion of said compressor cycle to reduce the temperature of said working fluid, said liquid injection circuit including an injection passage extending from a liquid supply member to an injection port formed in one of said scroll members; and a valve disposed within said injection passage to control the flow of said liquid. therethrough, said valve operating in response to a pressure difference between said discharge pressure and said suction pressure.

32. A scroll-type compressor having a compressor cycle for handling working fluid, said compressor compressing said working fluid between a suction pressure and a discharge pressure, said compressor comprising:

first and second scroll members having intermeshed spiral wraps;

a drive mechanism for causing said scroll members to engage in cyclical relative orbiting motion, said spiral wraps forming successive enclosed spaces which move during normal operation from a radially outer position where said working fluid is at a suction pressure to a radially inner central position where said working fluid is at a higher central pressure;

a liquid injection circuit for injecting a liquid into at least one of said enclosed spaces during one portion of said compressor cycle and into said radially inner central position during a different portion of said compressor cycle to reduce the temperature of said working fluid, said liquid injection circuit including an injection passage extending from a liquid supply member to an injection port formed in one of said scroll members; and a valve disposed within said injection passage to control the flow of said liquid therethrough, said valve operating in response to a pressure ratio defined by said discharge pressure and an intermediate pressure between said suction and discharge pressures.

33. A refrigeration system comprising:

a scroll-type compressor having a compressor cycle for handling a working fluid, said scroll type compressor compressing said working fluid between a suction pressure and a discharge pressure and having first and second scroll members interleaved, said first scroll member being adapted to orbit relative to said second scroll member so as to define a plurality of enclosed spaces which decrease in volume as they move toward the center of said scroll members to form a discharge space, one of said first and second scroll members having a central discharge passage leading from said discharge space to a discharge chamber;

a condenser;

an evaporator;

a conduit interconnecting said scroll-type compressor, said condenser and said evaporator in a closed loop series relationship;

a liquid injection conduit connected to said conduit between said condenser and said evaporator, said liquid injection conduit having an outlet opening into one of said plurality of enclosed spaces during one portion of said compressor cycle and to said discharge space during a different portion of said compressor cycle; and a valve disposed within said liquid injection conduit for controlling flow of liquid therethrough, said valve operating in response to a pressure difference between said discharge pressure and said suction pressure.

34. A refrigeration system comprising:

a scroll-type compressor having a compressor cycle for handling a working fluid, said scroll-type compressor compressing said working fluid between a suction pressure and a discharge pressure and having first and second scroll members interleaved, said first scroll member being adapted to orbit relative to said second scroll member so as to define a plurality of enclosed spaces which decrease in volume as they move toward the center of said scroll members to form a discharge space, one of said first and second scroll members having a central discharge passable leading from said discharge space to a discharge chamber;

a condenser;

an evaporator;

a conduit interconnecting said scroll-type compressor, said condenser and said evaporator in a closed loop series relationship;

a liquid injection conduit connected to said conduit between said condenser and said evaporator, said liquid injection conduit having an outlet opening into one of said plurality of enclosed spaces during one portion of said compressor cycle and to said discharge space during a different portion of said compressor cycle; and a valve disposed within said liquid injection conduit for controlling flow of liquid therethrough, said valve operating in response to a pressure difference between said discharge pressure and said suction pressure.

* * * * *

UNITED STATES PATENT AND TRADEMARK OFFICE

CERTIFICATE OF CORRECTION

PATENT NO. : 5,640,854

DATED : June 24, 1997

INVENTOR(S) : James F. Fogt; Jean-Luc Caillat

It is certified that error appears in the above-indentified patent and that said Letters Patent is hereby corrected as shown below:

Column 2, line 29, "solenoids" should be -- solenoid --.

Column 3, line 55, "rotatable" should be -- rotatably --.

Column 6, line 19, "condensor" should be -- condenser --.

Column 6, line 46, "enclose" should be -- enclosed --.

Column 8, line 43, "condensor" should be "condenser".

Column 8, line 50, "form" should be "from".

Column 9, line 38, "Plug" should be "plug".

Column 9, line 47, "int" should be -- in --.

Column 9, line 51, "pressures" should be "pressure".

Column 9, line 52, "pressure" should be -- pressures --.

UNITED STATES PATENT AND TRADEMARK OFFICE

CERTIFICATE OF CORRECTION

PATENT NO. : 5,640,854

DATED : June 24, 1997

INVENTOR(S) : James F. Fogt; Jean-Luc Caillat

It is certified that error appears in the above-indentified patent and that said Letters Patent is hereby corrected as shown below:

Column 13, line 41, "a" should be -- A --.

Column 14, line 23, after "handling" insert -- a --.

Column 16, line 1, "passable" should be -- passage --.

Signed and Sealed this

Sixth Day of January, 1998

*Attest:*

*Attesting Officer*

BRUCE LEHMAN

*Commissioner of Patents and Trademarks*